US008967237B2

(12) United States Patent
Seryi et al.

(10) Patent No.: US 8,967,237 B2
(45) Date of Patent: Mar. 3, 2015

(54) CONNECTION DEVICE FOR A COAXIAL TUBE HEAT EXCHANGER

(75) Inventors: Artem Seryi, Wiesbaden (DE); Lothar Seybold, Nauheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 970 days.

(21) Appl. No.: 12/964,670

(22) Filed: Dec. 9, 2010

(65) Prior Publication Data

US 2011/0139415 A1 Jun. 16, 2011

(30) Foreign Application Priority Data

Dec. 11, 2009 (DE) ..... 10 2009 057 954

(51) Int. Cl.

| | |
|---|---|
| ***F28D 7/10*** | (2006.01) |
| ***B21D 39/04*** | (2006.01) |
| ***B21D 53/06*** | (2006.01) |
| ***F28F 9/02*** | (2006.01) |

(52) U.S. Cl.

CPC ..... *B21D 53/06* (2013.01); *B21D 39/04* (2013.01); *F28D 7/106* (2013.01); *F28F 9/0246* (2013.01)

USPC ..... 165/154; 165/76; 285/382.4; 285/123.1; 285/123.3; 285/123.15

(58) Field of Classification Search

USPC ..... 165/154, 76; 285/123.3, 382, 382.4, 285/123.15, 123.1, 123.9, 222, 129.1, 256; 264/263

See application file for complete search history.

(56) References Cited

U.S. PATENT DOCUMENTS

| | | | |
|---|---|---|---|
| 6,070,618 | A | 6/2000 | Iwabuchi |
| 6,145,545 | A | 11/2000 | Hartnagel et al. |
| 7,753,413 | B2 | 7/2010 | Yoshino et al. |
| 2006/0096314 | A1 | 5/2006 | Nakamura et al. |

FOREIGN PATENT DOCUMENTS

| | | | |
|---|---|---|---|
| CN | 1979081 | A | 6/2007 |
| CN | 201242375 | Y | 5/2009 |
| DE | 1752255 | A1 | 6/1971 |
| DE | 19513559 | A1 | 10/1996 |
| DE | 19808012 | A1 | 8/1998 |
| DE | 69817598 | T2 | 3/2004 |
| DE | 102004004027 | A1 | 10/2004 |
| DE | 102005052972 | A1 | 6/2006 |
| JP | 2002181652 | A | 6/2002 |

OTHER PUBLICATIONS

German Patent Office, Search Report for German Application No. 102009057954.0, dated Oct. 27, 2010.

Chinese Office Action dated Jul. 28, 2014 for Chinese Patent Application No. 2010105709567.

*Primary Examiner* — Marc Norman

*Assistant Examiner* — Devon Russell

(74) *Attorney, Agent, or Firm* — Ingrassia Fisher & Lorenz, P.C.

(57) ABSTRACT

A connection device of a double-walled heat exchanger tube is provided, in particular for the heat exchanger of a motor vehicle air conditioning system. The heat exchanger tube has an outer tube and an inner tube that runs coaxially inside the outer tube spaced radially apart from it. The connection device further has a fitting for accommodating radially overlapping end sections of the inner and outer tube. The outer and inner tubes according to the invention are at least sectionally joined together without soldering in the area of the fitting, and with the fitting.

16 Claims, 1 Drawing Sheet

CONNECTION DEVICE FOR A COAXIAL TUBE HEAT EXCHANGER

CROSS-REFERENCE TO RELATED APPLICATION

This application claims priority to German Patent Application No. 102009057954.0, filed Dec. 11, 2009, which is incorporated herein by reference in its entirety.

TECHNICAL FIELD

The technical field relates to a connection device for a coaxial tube heat exchanger, which is provided in particular for a motor vehicle air conditioning system, and designed for installation in a corresponding coolant circulation. In addition, the technical field relates to a correspondingly configured motor vehicle air conditioning system and a method for establishing a fluid-carrying coaxial pipe connection for such heat exchangers.

BACKGROUND

Double-walled heat exchanger tubes are basically known for motor vehicle air conditioning systems. For example, DE 10 2005 052 972 A1 discloses a double-walled heat exchanger tube running between the capacitor and expansion valve of a motor vehicle air conditioning system. The double-walled tube here forms part of a high-pressure tube for transporting a high-pressure coolant issued by the compressor, as well as part of a low-pressure tube for transporting a low-pressure coolant from the evaporator to the compressor. The double-walled heat exchanger tube here has an outer tube and inner tube. The inner tube runs in the outer tube in such a way as to penetrate through the outer tube. The longitudinal end sections of the outer tube have a reduced diameter, so as to form reduced connecting parts. These reduced connecting parts of the outer tube are directed radially inward, and welded with the inner tube in a liquid or air tight state. In this way, the outer tube and inner tube define a fluid-carrying channel.

Soldering or welding the inner and outer tube is a relatively complex procedure from a production standpoint. It uses a separate welding or soldering procedure provided for this purpose. The soldered or welded junction also constitutes a weak point in the high-pressure coolant circulation. In order to ensure adequate tightness, the welded or soldered junction just be fabricated with the greatest possible precision. Further, such soldered or welded junctions are susceptible to corrosion precisely during long-term operation.

Therefore, at least one object is to provide an improved joining of the ends of a coaxial heat exchanger tube that from the standpoint of assembly is especially easy and inexpensive to realize, and also exhibits an improved corrosion resistance. In addition, other objects, desirable features and characteristics will become apparent from the subsequent summary and detailed description, and the appended claims, taken in conjunction with the accompanying drawings and this background.

SUMMARY

The connection device according to an embodiment is provided for a double-walled heat exchanger tube. The heat exchanger tube has an outer tube and an inner tube that runs coaxially inside the outer tube. The inner and outer tubes have different radii, thereby forming a fluid-carrying channel between the outside of the inner tube and inside of the outer tube, through which a coolant preferably exposed to a high pressure can flow.

The inner tube is designed to carry a low-pressure coolant flowing in the opposite direction. In this way, a thermal coupling and corresponding heat exchange can be achieved between the coolant flowing through the inner tube and outer channel. The connection device further has a fitting to receive overlapping end sections of the inner and outer tube.

The fitting encompasses the concentrically telescoping tubes in the circumferential direction. The fitting comes to abut only with the outer tube, for example. To avoid a soldered or welded joint, an embodiment provides that the outer tube and inner tube are joined together at least sectionally in the area of the fitting, and that the outer tube, and if needed the inner tube as well, is joined with the fitting unsoldered. In terms of this description, an unsoldered joint is meant as a joining technique in which the bordering surfaces of the inner tube, outer tube and fitting are joined together neither by soldering, nor by welding. This is because the embodiments provide that the two tubes and fitting be joined together positively and/or non-positively.

A first embodiment provides that the unsoldered joint between the inner tube, outer tube and fitting be established by forming an interference fit between the inner tube, outer tube and fitting. In other words, the inner tube, outer tube and fitting are subjected to plastic deformation in the area of the fitting, e.g., mutual press molding, so that the inner tube, outer tube and fitting are permanently joined together even without a welding or soldering operation, but primarily in a gas and/or liquid-tight manner.

In particular, the embodiment involves establishing the unsoldered joint between the inner tube, outer tube and fitting by means of a so-called cold-press molding operation. Cold press molding the inner tube, outer tube and accompanying fitting makes it especially easy to create an unsoldered positive and/or non-positive joining between the inner tube, outer tube and fitting, in particular also without thermally heating the tube ends and fitting.

Another embodiment provides that the fitting facing the end section of the tube in the joining area over the inner and outer tube have at least one radial recess, meaning a radial expansion, and an essentially cylindrical inner wall section adjacent thereto toward the tube end. The radial recess is designed as a radial expansion of an end receptacle of the fitting that accommodates the end sections of the tube. It is further provided that cold press molding imparts a shape to both the inner and outer tube that corresponds to the radial recess. In this way, the molding operation can yield at least a unidirectional axial fixation of the inner and outer tube relative to the fitting.

Another embodiment provides that the fitting itself acts as a matrix for the cold press molding operation. From a technical standpoint, it is here provided that the initially cylindrical tubes are introduced into the end receptacle of the fitting, and then subjected to a molding operation that radially expands the tubes. In this way, a shape corresponding to the end receptacle of the fitting is imparted to the end sections of the inner and outer tube. However, as an alternative to the above, it can be provided that the fitting and two tubes together are molded into a gas and/or liquid-tight joint during the cold press molding process.

Also provided within the embodiments is that the fitting have an end receptacle, in which the preferably cold-press molded ends of the outer and inner tube come to lie. This end receptacle of the fitting is open toward the tube ends, so that a corresponding counter-fitting can be used to fabricate a sealing joint. The end receptacle of the fitting is here radially expanded relative to the tube diameter of the inner and/or outer tube. Cold press molding the inner and outer tube in the area of the end receptacle of the fitting makes it possible to achieve the sealing interference fit according to the invention between the inner tube, the outer tube, and the fitting.

Also provided for the embodiment is that the outer tube have a radially expanded contact flange, which axially supports the outer tube against the fitting. This support preferably takes place on the side of the fitting lying opposite the end receptacle, thereby enabling the establishment of a complete axial fixation between the outer tube and fitting. Cold press molding also makes it possible to press mold the inner tube with the outer tube, so that it can be fixated relative to the fitting via the outer tube.

Also provided is that the outer and inner tube essentially abut flush in the area of the fitting, and are largely non-positively joined together in this area via their abutting outsides and insides by means of the cold press molding process.

Another embodiment provides that the end of the fitting lying opposite the free end of the tube has a radially expanding, preferably conically expanding tube receptacle for the outer tube. By contrast, the inner tube in the area of this tube receptacle follows a largely cylindrical progression, while the outside of the outer tube largely abuts the tube receptacle that radially expands conically away from the free end of the tube. When the tube is viewed in the opposite direction, meaning toward its free end, the outer tube tapers radially inward in the area of the tube receptacle. While the outer tube and inner tube largely abut over their entire surface toward the end receptacle of the fitting, and are press molded in this area, the rube receptacle section of the fitting instead provides that the outer tube rises radially outward from the inner tube. As a result, the fluid-carrying channel formed between the outer and inner tube begins in this area.

One further embodiment provides that the fitting has an outwardly projecting connecting piece at the height of the tube receptacle, which is in fluidic communication with the channel formed between the inner tube and outer tube.

It is here provided in particular that the connecting piece can also be joined with the fitting without soldering, so that a fluid-carrying connection can in the final analysis be routed through the outer tube wall as described in the invention without soldering or welding. It is here provided in particular that the fitting in the area of the tube receptacle has a borehole that passes radially through the outer tube, and ends in the connecting piece. This borehole is here preferably only introduced into the fitting once cold press molding is complete. Since the outer tube is tightly press molded with the fitting in its preferably conically expanding tube receptacle area, and the radially expanded bead of the outer tube borders the surface of the fitting from outside, a sufficient level of tightness is provided for this fluid-carrying borehole and the fluid-carrying fitting.

A further embodiment provides that the connecting piece be screwed with a connecting part. This also makes it possible to easily avoid a soldered or welded joint. The inner and outer tubes are preferably fabricated out of metal, in particular steel or high-grade steel. The fitting can also be made out of a steel material. However, it is also conceivable for the fitting to be fabricated out of a light structural material, such as aluminum.

Another embodiment further relates to a tubular coaxial heat exchanger having at least one outer tube and one inner tube. It has at least one previously described connection device to establish a fluid-carrying coupling with the remaining components of the air conditioning system or its coolant circulation. It is here provided in particular that the inner tube relays a low-pressure coolant flowing out of the evaporator to the compressor, and that the fluid-carrying channel between the inner and outer tube provides a fluid-carrying connection between the capacitor and expansion valve, in which the typically fluidic coolant under a high pressure streams opposite the low-pressure gaseous coolant flowing in the inner tube. However, it is also conceivable as an alternative to the above that the low-pressure coolant in the outer channel flows opposite a high-pressure coolant streaming in the inner tube.

Another embodiment further relates to a method for manufacturing the connection device. In a first step, the outer tube and inner tube are here provided. The inner tube having a lower outer diameter than the outer tube is completely incorporated into the outer tube and arranged concentrically thereto. Both tubes are subsequently introduced into a fitting that envelops the tube axially at least regionally, but completely in the circumferential direction. With this fitting in this way lying at the free ends of the tubes that preferably come to abut each other in a flush manner, a molding operation is subsequently performed, in particular a cold press molding process, so as to establish an unsoldered joint between the outer tube, inner tube and fitting, thereby yielding a positive and/or non-positive connection between the three components.

The fitting itself can here act as a female mold, while a press molding stamp designed as a male mold enters the open end of the outer and inner tubes that comes to rest in the fitting area to effect their radial expansion. Naturally, it is here further provided that both the outer and inner tubes are axially fixed. Also reflective of the invention is for the outer tube opposite the free end or open end of the connecting piece is radially expanded like a bead during the molding operation in the form of a corresponding compression, which the outer tube can use to support itself against the connecting piece.

Another embodiment provides that, after the outer tube, inner tube and fitting have been press molded, a borehole that passes through only the outer tube is introduced into the fitting in the area of an expanding tube receptacle of the fitting that faces radially, roughly conically away from the free tube end. This borehole makes it possible to create an outside attachment for the fluid-carrying channel running between the outer and inner tubes, so that a fluid-carrying connection of the channel to the outside can be provided, for example via the screwed attachment of a connecting piece that comes to lie flush with the borehole.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
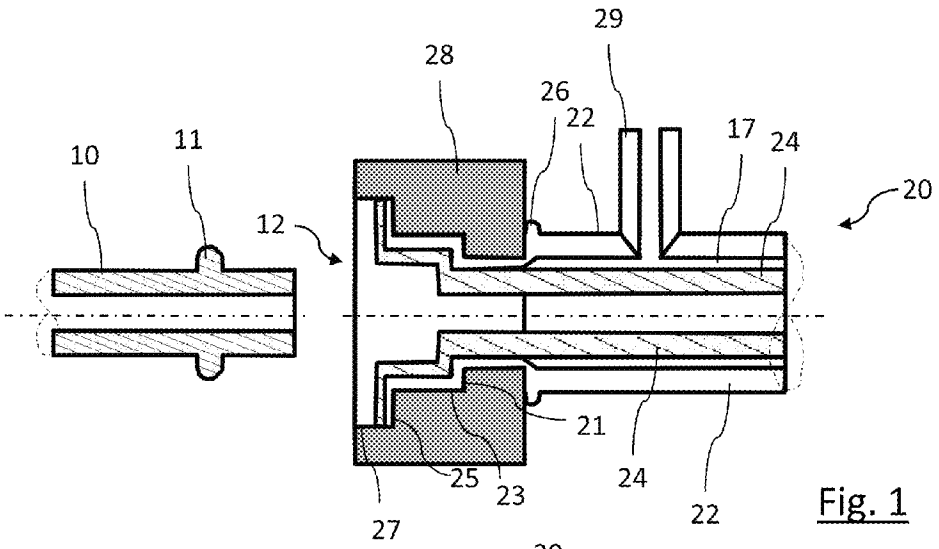
FIG. 1 is a cross sectional view of a first embodiment of a connection device for a coaxial tube heat exchanger.

The double-walled tube 20 according to FIG. 1 has an outer tube 22 and an inner tube 24 incorporated concentrically therein. The tube ends on the left o the figures are here incorporated into a fitting 28. They are preferably cold press molded with the latter, so as to achieve an unsoldered connection between the inner tube 24 and outer tube 22 on the one hand, and a corresponding unsoldered connection between the outer tube 22 and fitting 28 on the other.

In order to establish a positive and/or non-positive connection between the outer tube 22, inner tube 24 and fitting 28, the fitting 28 has stepped recesses toward the free end section lying to the left. Viewed from right to left, meaning toward the free end of the tubes 22, 24, the end receptacle 12 of the fitting 28 initially has a radially outwardly projecting recess 21, which is bordered by a cylindrical inner wall piece 23.

This inner wall section 23 also ends at another radial, outwardly directed recess 25, at which is formed a cylindrical section 27 that extends between the free end of the fitting 28 and the radially outwardly directed recess 25. The end receptacle 12 of the fitting 28 is hence successively provided with two stepped shoulders, or with corresponding pedestal sections.

In order to achieve a mutual gas and/or fluid-tight attachment, it is provided that the concentrically telescoping tubes 22, 24 be pressed through the fitting 28 in their initial state, and then be expanded as viewed from the left on FIG. 1 using a suitable compression mold in such a way as to adjust the inner and outer tubes to the contour of the end receptacle 12 of the fitting 28. The molding process here is accompanied by a plastic deformation of at least the outer tube 22 and inner tube 24, thereby making it possible to largely offset any elastic restoring forces of the tubes 22, 24 that might otherwise be present. Opposite the end receptacle 12, the outer tube 22 is provided with a bead-like, radial expansion 26, with which an additional axial support of the outer tube 22 and fitting 28 can be achieved.

This radial expansion 26 in the form of a bead-like expansion can also be formed during the cold press molding process. However, it is also conceivable to provide the outer tube 22 with such a bead before the molding process that forms the gas and/or liquid-tight connection. The fitting 28 has attachment means lying outside the end receptacle 12 to secure the fitting 28 to additional fluid-carrying systems, such as to a tube 10. The tube is here designed to be inserted into the press molded end receptacle 12 to provide a fluid-carrying connection between the inner tube 24 and the tube 10. The tube 10 also has a radially expanded contact flange 11, which allows the tube to be supported against the end of the inner tube 24 outwardly offset like a flange.

The tube 10 is advantageously joined in a manner not depicted in any greater detail with its own fitting, which can be secured to correspond with the fitting 28 by means of attachment means provided for this purpose, such as bolts. The stepped or incrementally offset radial expansion of the end receptacle 12 and the tubes 24, 22 press molded therein is such that the end section of the tube 10 facing the end receptacle 12, which comes to lie to the right of the flange section 11 on FIG. 1, can be introduced into the end receptacle 12 to form a seal.

In the embodiment according to FIG. 1, the inner tube 24 abuts the enveloping outer tube 22 over essentially or largely its entire surface in the area of the fitting 28. The fluid-carrying channel 17 between the inner tube 24 and outer tube 22 hence only begins at the point where the inner tube 24 and outer tube 22 project out of the fitting 28 as viewed toward the right. In order to provide a fluid-tight supply in the outer channel 17, the outer tube 22 is coupled with a stub pipe 29. For example, the latter can be connected positively and/or non-positively with the outer tube 22, e.g., via a threaded joint. As an alternative, however, the stub pipe 29 as a connecting piece and outer tube 22 can be joined by means of a soldered or welded joint.

Figure 2:
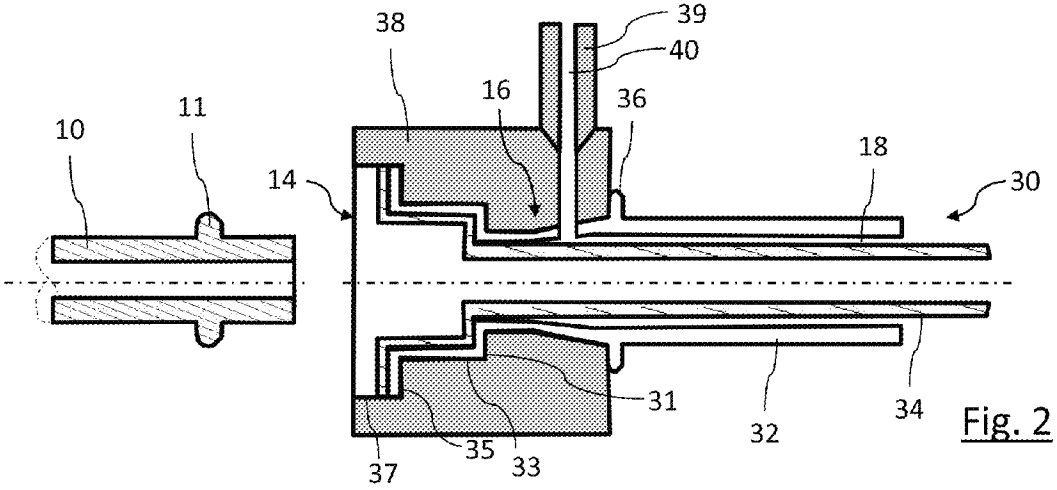
FIG. 2 is an alternative embodiment of the attachment in a comparable view.

While the alternative embodiment according to FIG. 2 provides a slightly modified fitting 38, the stepped press molding of the inner tube 34 and outer tube 32 is formed on the staircase-like, radial expansion 31, 33, 35, 37 of an end receptacle 14, comparable to the one on FIG. 1. However, the end receptacle 14 has situated opposite to it a conically radially expanding tube receptacle 16, in the area of which the outer tube 32 expands radially outward, so that the channel 18 between the outer tube 32 and inner tube 34 already begins inside the tube receptacle 16 of the fitting 38. At least one advantage is that incorporating a radially inwardly directed borehole 40 in this way makes it possible to penetrate through the outer tube 32 in the area of the tube receptacle 16, so that a connecting piece 39 can be secured to the fitting 38 to establish a fluidic communication to the channel 18 that leads to the outside, making it possible to fabricate the this fluidic communication without soldering or welding.

Similarly to the coaxial tube 20 according to FIG. 1, the coaxial tube 30 according to FIG. 2 provides a radially expanded contact flange 36, which the outer tube 32 can use to support itself against the fitting 38 in an axial direction. The connecting piece 39 can be secured to the fitting 38 itself by means of a threaded joint. The radial extension of the fitting 38 is here sufficient to provide a fluid and/or gas-tight threaded joint. If necessary, sealing rings can be used to provide a better seal in the area of the screwed joint between the connecting piece 39 and fitting 38, but also in the area of the contact flange 26, 36 adjoining the outside of the fitting 28, 38.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A connection device of a double-walled heat exchanger tube having an inner tube and an outer tube, comprising:

the inner tube running coaxially inside the outer tube and spaced radially apart from the outer tube;

a fitting radially overlapping end sections of the inner tube and the outer tube; and an unsoldered joint joining the fitting and the outer tube, the same unsoldered joint joining the inner tube directly to the outer tube, at least sectionally in an area of the fitting.

2. The connection device according to claim 1, wherein the unsoldered joint between the inner tube, the outer tube and the fitting is formed with an interference fit.

3. The connection device according to claim 1, wherein the unsoldered joint between the inner tube, the outer tube and the fitting is formed with a cold press molding operation.

4. The connection device according to claim 1, wherein the fitting comprises a radial recess and an essentially cylindrical inner wall section.

5. The connection device according to claim 3, wherein the fitting is a female mold the cold press molding.

6. The connection device according to claim 1, wherein ends of the outer tube and the inner tube lie in an end receptacle of the fitting that is radially expanded relative to a tube diameter.

7. The connection device according to claim 1, wherein the outer tube comprises a radially expanded contact flange that axially supports the outer tube against the fitting.

8. The connection device according to claim 1, wherein the outer tube abuts the inner tube in a flush manner in the area of the fitting.

9. The connection device according to claim 1, wherein an end of the fitting lying opposite a free end comprises a radially expanding tube receptacle for the outer tube in which the inner tube is essentially cylindrical.

10. The connection device according to claim 9, wherein the fitting comprises a connecting piece in fluidic communication with a channel formed between the inner tube and the outer tube.

11. The connection device according to claim 10, wherein the fitting in the area of the radially expanding tube receptacle comprises a borehole radially through the outer tube and ending in the connecting piece.

12. The connection device according to claim 10, wherein the connecting piece is connected with a screwed joint.

13. A motor vehicle air conditioning system, comprising:

a coaxial heat exchanger;

an outer tube of the coaxial heat exchanger;

an inner tube of the coaxial heat exchanger that runs coaxially inside the outer tube spaced radially apart from the outer tube;

a fitting radially overlapping end sections of the inner tube and the outer tube; and an unsoldered joint joining the fitting to the outer tube, the same unsoldered joint joining the inner tube directly to the outer tube, at least sectionally in an area of the fitting.

14. The motor vehicle air conditioning system according to claim 13, wherein the unsoldered joint between the inner tube, the outer tube and the fitting is formed with an interference fit.

15. The motor vehicle air conditioning system according to claim 13, wherein the unsoldered joint between the inner tube, the outer tube and the fitting is formed with a cold press molding operation.

16. The motor vehicle air conditioning system according to claim 13, wherein the fitting comprises a radial recess and an essentially cylindrical inner wall section.

* * * * *